US011261077B1

(12) United States Patent
Abeygunawardana et al.

(10) Patent No.: US 11,261,077 B1
(45) Date of Patent: Mar. 1, 2022

(54) ADJUSTABLE DRIP TRAY FOR A DISPENSING ASSEMBLY

(71) Applicant: Haier US Appliance Solutions, Inc., Wilmington, DE (US)

(72) Inventors: Danister Abeygunawardana, Jeffersonville, IN (US); Jianwu Li, Louisville, KY (US); Gregory Scott Carr, Louisville, KY (US); Brent Alden Junge, Evansville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/002,882

(22) Filed: Aug. 26, 2020

(51) Int. Cl.
*B67D 1/16* (2006.01)
*F25D 23/12* (2006.01)

(52) U.S. Cl.
CPC ..... *B67D 1/16* (2013.01); *F25D 23/126* (2013.01)

(58) Field of Classification Search
CPC ..... B67D 1/16; F25D 23/126
See application file for complete search history.

(56) References Cited

U.S. PATENT DOCUMENTS 5,782,380 A * 7/1998 DiSanto ..... B67D 1/08 141/369
7,478,584 B2 1/2009 Turi
7,762,292 B2 * 7/2010 Buchstab ..... A47J 31/4482 141/369
8,250,880 B2 * 8/2012 Moon ..... F25D 23/126 62/389
8,517,484 B2 * 8/2013 Eckartsberg ..... F25D 23/126 312/405.1
9,844,293 B2 * 12/2017 Miller ..... A47J 31/4482
2007/0266861 A1 * 11/2007 Hart ..... B67D 1/1256 99/279
2008/0184730 A1 * 8/2008 Voglewede ..... F25D 23/126 62/389
2010/0071401 A1 * 3/2010 Jang ..... F25D 23/028 62/391
2018/0299184 A1 10/2018 Abeygunawardana

FOREIGN PATENT DOCUMENTS

WO WO2016015119 A1 4/2016

* cited by examiner

*Primary Examiner* — Frederick C Nicolas
(74) *Attorney, Agent, or Firm* — Dority & Manning, P.A.

(57) ABSTRACT

A dispensing assembly for an appliance includes a dispenser and a mounting panel positioned below the dispenser, the mounting panel defining a sliding pocket and a locking indentation. A tray assembly is slidably mounted to the mounting panel within the sliding pocket and includes a drip tray defining a locking flange for receipt within the sliding pocket and a plunger mechanism movably mounted to the drip tray for moving a locking pin between an engaged position where the vertical position of the drip tray is locked and a disengaged position where the drip tray is movable along the vertical direction.

20 Claims, 9 Drawing Sheets

ADJUSTABLE DRIP TRAY FOR A DISPENSING ASSEMBLY

FIELD OF THE INVENTION

The present subject matter relates generally to ice and or beverage dispensers, and more particularly to adjustable drip trays for use with beverage dispensers.

BACKGROUND OF THE INVENTION

Refrigerator appliances generally include a cabinet that defines a chilled chamber for receipt of food articles for storage. In addition, refrigerator appliances include one or more doors rotatably hinged to the cabinet to permit selective access to food items stored in chilled chamber(s). The refrigerator appliances can also include various storage components mounted within the chilled chamber and designed to facilitate storage of food items therein. Such storage components can include racks, bins, shelves, or drawers that receive food items and assist with organizing and arranging of such food items within the chilled chamber.

In addition, conventional refrigerator appliances include dispensing assemblies for dispensing liquid water and/or ice, e.g., through a dispenser mounted on a front of the appliance or within the cabinet. These dispensing assemblies typically operate by dispensing water and/or ice into a container that is positioned at a fixed vertical position. However, containers come in a variety of heights and sizes, such that filling certain containers using a single position support platform results in splashing or in a less than optimal fill process. Certain refrigerator appliances or beverage dispensers include adjustable platforms, but such platforms are typically complex, including drive motors, belt or chain drives, or other complicated mechanisms. Notably, these mechanisms increase the cost of the beverage dispenser while increasing the likelihood of component failures and maintenance visits.

Accordingly, a refrigerator appliance with an improved dispensing assembly would be useful. More particularly, a dispensing assembly for a refrigerator appliance or other beverage dispenser that includes a low cost, adjustable drip tray or support platform that is simple to operate would be particularly beneficial.

BRIEF DESCRIPTION OF THE INVENTION

Aspects and advantages of the invention will be set forth in part in the following description, or may be apparent from the description, or may be learned through practice of the invention.

In one exemplary embodiment, a dispensing assembly for an appliance is provided. The dispensing assembly defines a vertical direction, a lateral direction, and a transverse direction and includes a dispenser for dispensing ice or a beverage, a mounting panel positioned below the dispenser, the mounting panel defining a sliding pocket and a locking indentation within the sliding pocket, and a tray assembly movably mounted to the mounting panel. The tray assembly includes a drip tray defining a support surface and a locking flange for receipt within the sliding pocket and a plunger mechanism movably mounted to the drip tray and being configured for moving between an engaged position where a locking pin of the plunger mechanism engages the locking indentation to lock the drip tray in position along the vertical direction and a disengaged position where the locking pin is retracted such that the drip tray is movable along the vertical direction.

In another exemplary embodiment, a tray assembly for a dispensing assembly is provided. The dispensing assembly includes a dispenser and a mounting panel positioned below the dispenser and defining a locking indentation within a sliding pocket. The tray assembly includes a drip tray defining a support surface and a locking flange for receipt within the sliding pocket and a plunger mechanism movably mounted to the drip tray and being configured for moving between an engaged position where a locking pin of the plunger mechanism engages the locking indentation to lock the drip tray in position along a vertical direction and a disengaged position where the locking pin is retracted such that the drip tray is movable along the vertical direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
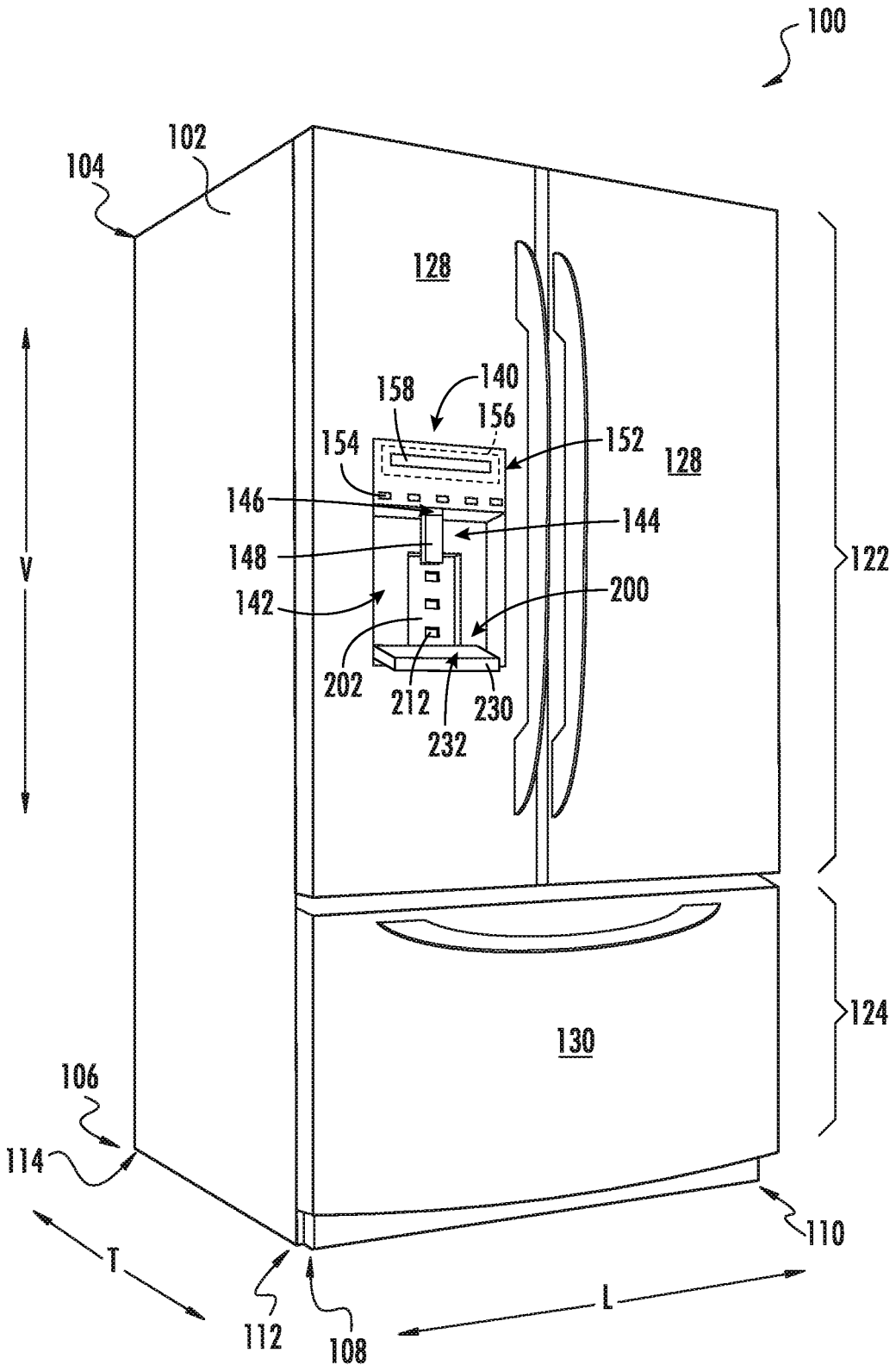
FIG. 1 provides a perspective view of a refrigerator appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a refrigerator appliance 100 according to an exemplary embodiment of the present subject matter. Refrigerator appliance 100 includes a cabinet or housing 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another.

Housing 102 defines chilled chambers for receipt of food items for storage. In particular, housing 102 defines fresh food chamber 122 positioned at or adjacent top 104 of housing 102 and a freezer chamber 124 arranged at or adjacent bottom 106 of housing 102. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance, a side-by-side style refrigerator appliance, or a single door refrigerator appliance. Moreover, aspects of the present subject matter may be applied to other appliances as well, such as other appliances including beverage dispensers. Consequently, the description set forth herein is for illustrative purposes only and is not intended to be limiting in any aspect to any particular appliance or configuration.

Refrigerator doors 128 are rotatably hinged to an edge of housing 102 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1. One skilled in the art will appreciate that other chamber and door configurations are possible and within the scope of the present invention.

Figure 2:
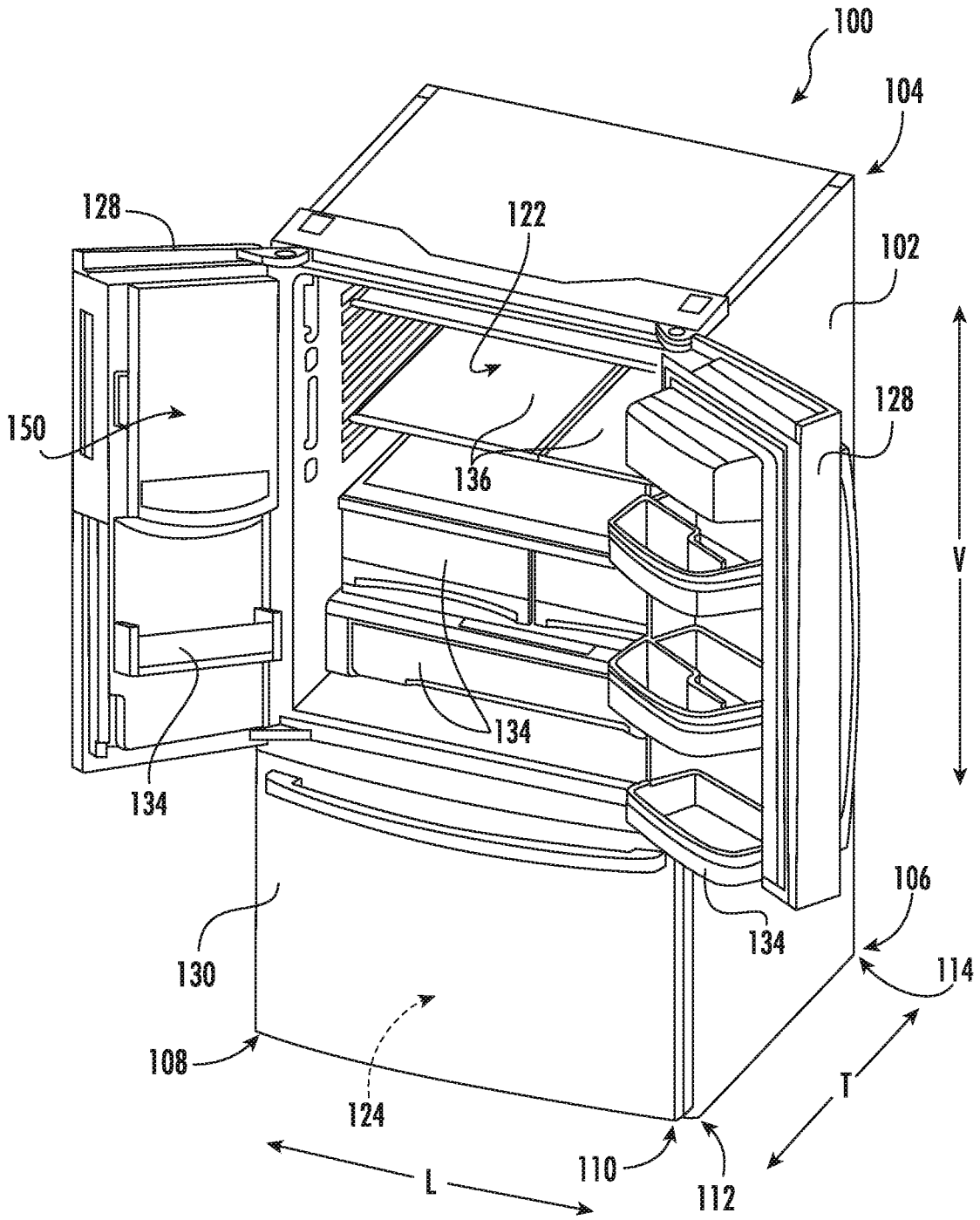
FIG. 2 provides a perspective view of the exemplary refrigerator appliance of FIG. 1, with the doors of the fresh food chamber shown in an open position.

FIG. 2 provides a perspective view of refrigerator appliance 100 shown with refrigerator doors 128 in the open position. As shown in FIG. 2, various storage components are mounted within fresh food chamber 122 to facilitate storage of food items therein as will be understood by those skilled in the art. In particular, the storage components may include bins 134 and shelves 136. Each of these storage components are configured for receipt of food items (e.g., beverages and/or solid food items) and may assist with organizing such food items. As illustrated, bins 134 may be mounted on refrigerator doors 128 or may slide into a receiving space in fresh food chamber 122. It should be appreciated that the illustrated storage components are used only for the purpose of explanation and that other storage components may be used and may have different sizes, shapes, and configurations.

Referring again to FIG. 1, a dispensing assembly 140 will be described according to exemplary embodiments of the present subject matter. Although several different exemplary embodiments of dispensing assembly 140 will be illustrated and described, similar reference numerals may be used to refer to similar components and features. Dispensing assembly 140 is generally configured for dispensing liquid water and/or ice. Although an exemplary dispensing assembly 140 is illustrated and described herein, it should be appreciated that variations and modifications may be made to dispensing assembly 140 while remaining within the present subject matter.

Dispensing assembly 140 and its various components may be positioned at least in part within a dispenser recess 142 defined on one of refrigerator doors 128. In this regard, dispenser recess 142 is defined on a front side 112 of refrigerator appliance 100 such that a user may operate dispensing assembly 140 without opening refrigerator door 128. In addition, dispenser recess 142 is positioned at a predetermined elevation convenient for a user to access ice and enabling the user to access ice without the need to bend-over. In the exemplary embodiment, dispenser recess 142 is positioned at a level that approximates the chest level of a user.

Dispensing assembly 140 includes a dispenser 144 including a discharging outlet 146 for discharging ice, water, or any other suitable beverage from dispensing assembly 140. An actuating mechanism 148, shown as a paddle, is mounted below discharging outlet 146 for operating dispenser 144. In alternative exemplary embodiments, any suitable actuating mechanism may be used to operate dispenser 144. For example, dispenser 144 can include a sensor (such as an ultrasonic sensor) or a button rather than the paddle. Discharging outlet 146 and actuating mechanism 148 are an external part of dispenser 144 and are mounted in dispenser recess 142. By contrast, refrigerator door 128 may define an icebox compartment 150 (FIG. 2) housing an icemaker and an ice storage bin (not shown) that are configured to supply ice to dispenser recess 142.

A control panel 152 is provided for controlling the mode of operation. For example, control panel 152 includes one or more selector inputs 154, such as knobs, buttons, touch-screen interfaces, etc., such as a water dispensing button and an ice-dispensing button, for selecting a desired mode of operation such as crushed or non-crushed ice. In addition, inputs 154 may be used to specify a fill volume or method of operating dispensing assembly 140. In this regard, inputs 154 may be in communication with a processing device or controller 156. Signals generated in controller 156 operate refrigerator appliance 100 and dispensing assembly 140 in response to selector inputs 154. Additionally, a display 158, such as an indicator light or a screen, may be provided on control panel 152. Display 158 may be in communication with controller 156 and may display information in response to signals from controller 156.

As used herein, "processing device" or "controller" may refer to one or more microprocessors or semiconductor devices and is not restricted necessarily to a single element. The processing device can be programmed to operate refrigerator appliance 100, dispensing assembly 140 and other components of refrigerator appliance 100. The processing device may include, or be associated with, one or more memory elements (e.g., non-transitory storage media). In some such embodiments, the memory elements include electrically erasable, programmable read only memory (EEPROM). Generally, the memory elements can store information accessible processing device, including instructions that can be executed by processing device. Optionally, the instructions can be software or any set of instructions and/or data that when executed by the processing device, cause the processing device to perform operations.

Referring now generally to FIGS. 3 through 9, a tray assembly 200 which may be used with refrigerator appliance 100 will be described according to exemplary embodiments of the present subject matter. Specifically, tray assembly 200 may be used with dispensing assembly 140 of refrigerator appliance 100 to dispense a desired amount or level of water and/or ice into a container, which may be a cup, utensil, pot, or other storage reservoir. Although tray assembly 200 is described herein as being used with dispensing assembly 140 of refrigerator appliance 100, it should be appreciated that aspects of the present subject matter may be used with any other beverage dispensing system, icemaker, etc. Indeed, aspects of the present subject matter may be used in a variety of other applications to support an item at a plurality of desired vertical positions, e.g., during a dispensing or filling process. The description herein with respect to refrigerator appliance 100 is only exemplary and is not intended to limit the scope of the present subject matter in any manner.

Refrigerator appliance 100 may include a mounting panel 202 that is positioned on front side 112 of refrigerator door 128. More specifically, according to the illustrated embodiment, mounting panel 202 is positioned in the backside of dispenser recess 142. Although mounting panel 202 is described herein as being part of refrigerator appliance 100 or dispensing assembly 140, it should be appreciated that mounting panel 202 could alternatively be a part of tray assembly 200 and can be mounted on any suitable structure to facilitate tray movement as described herein. As shown, dispensing assembly 140 or mounting panel 202 defines a vertical direction V, a lateral direction L, and a transverse direction T. According to the illustrated embodiment these directions correspond with the same directions as described above with respect to refrigerator appliance 100 when mounting panel 202 is installed. Therefore, these directional notations will be used interchangeably when referring to refrigerator appliance 100, dispensing assembly 140, and tray assembly 200.

Figure 3:
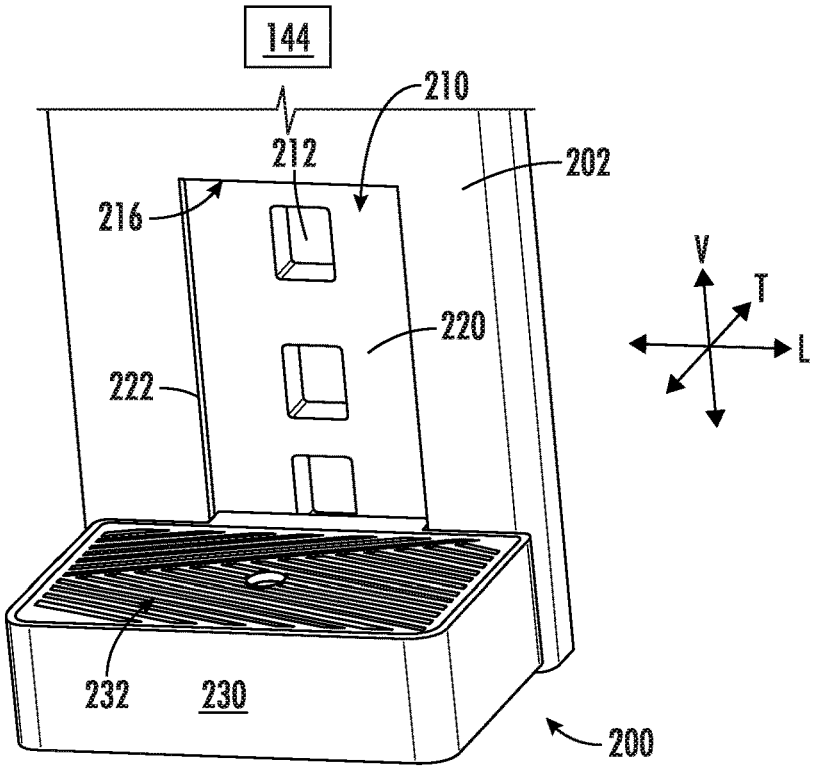
FIG. 3 provides a perspective view of a dispensing assembly that may be used with the exemplary refrigerator appliance of FIG. 1 according to an exemplary embodiment of the present subject matter.

As best shown in FIGS. 1 and 3, dispenser 144 of dispensing assembly 140 is generally positioned above mounting panel 202. In this manner, mounting panel 202 may be used to support tray assembly 200, which further supports a container or utensil for receiving ice and/or water discharge from dispenser 144 under the force of gravity. Mounting panel 202 may generally be constructed from any suitably rigid material. For example, mounting panel 202 (and other components of tray assembly 200) may be formed by injection molding, e.g., using a suitable plastic material, such as injection molding grade Polybutylene Terephthalate (PBT), Nylon 6, high impact polystyrene (HIPS), or acrylonitrile butadiene styrene (ABS). Alternatively, according to the exemplary embodiment, these components may be compression molded, e.g., using sheet molding compound (SMC) thermoset plastic or other thermoplastics. According still other embodiments, mounting panel 202 may be formed from metal or any other suitable rigid material, such as sheet metal.

Referring still to FIGS. 3 through 9, mounting panel 202 may generally include features for supporting tray assembly 200 during operation. More specifically, as explained in detail below, tray assembly 200 may generally be configured for being selectively movable along the vertical direction V into a desired vertical position. When in the desired position, tray assembly 200 may be configured for engaging mounting panel 202 to lock tray assembly 200 in position, e.g., to facilitate a dispensing process. It should be appreciated that the way tray assembly 200 engages panel 202 may vary while remaining within the scope of the present subject matter. The engagement mechanisms described herein are only exemplary and are not intended to limit the scope of the present subject matter.

According to the embodiment illustrated in FIGS. 3 through 9, mounting panel defines a sliding pocket 210 and a plurality of locking indentations 212. More specifically, as shown, sliding pocket 210 is a recess defined in mounting panel 202 that extends substantially along the vertical direction V between a bottom wall 214 and a top wall 216, along the lateral direction L between lateral side walls 218, and forward along the transverse direction T from a back wall 220. A front side of sliding pocket 210 is generally defined by forward flanges 222 that extend at least partially toward a center of sliding pocket 210 for engaging tray assembly 200, as will be described in more detail below. In general, when tray assembly 200 is mounted within sliding pocket 210, forward flanges 222 are configured for preventing movement of tray assembly 200 along the lateral direction L and the transverse direction T, while permitting vertical motion within sliding pocket 210, relative to mounting panel 202.

Locking indentations 212 are features defined within sliding pocket 210 that are generally configured for being selectively engaged by tray assembly 200 to prevent motion along the vertical direction V. In this regard, according to the embodiment illustrated in FIGS. 3 through 9, locking indentations 212 are a plurality of recesses defined in back wall 220 of sliding pocket 210 that have a substantially square or rectangular cross-section. As shown, locking indentations 212 are spaced apart along the vertical direction V to provide different vertical locations where tray assembly 200 may locking into vertical position. Although three locking indentations 212 are illustrated, it should be appreciated that the size, shape, and position of locking indentations 212 may vary while remaining within the scope of the present subject matter. For example, according still other embodiments, the locking indentation 212 may include a vertically elongated slot with a stairstep structure positioned therein. In this manner, a depth of the locking indentation 212 as measured along the transverse direction T may increase progressively toward a top of the locking indentation 212. So configured, a user may position tray assembly 200 at any suitable vertical location within sliding pocket 210 and tray assembly 200 may lock in position on whichever stairstep it is located when released.

Referring still to the figures, tray assembly 200 may include various features for selectively positioning tray assembly 200 within sliding pocket 210. For example, according to the illustrated embodiment, tray assembly 200 includes a drip tray 230 that defines a support surface 232 that is configured for receiving a cup or container. In this regard, when tray assembly 200 is properly mounted onto mounting panel 202, support surface 232 extends substantially within a horizontal plane, e.g., defined by the lateral direction L and transverse direction T. According to the illustrated embodiment, the drip tray 230 generally serves as the housing for containing the working components of tray assembly 200.

Figure 4:
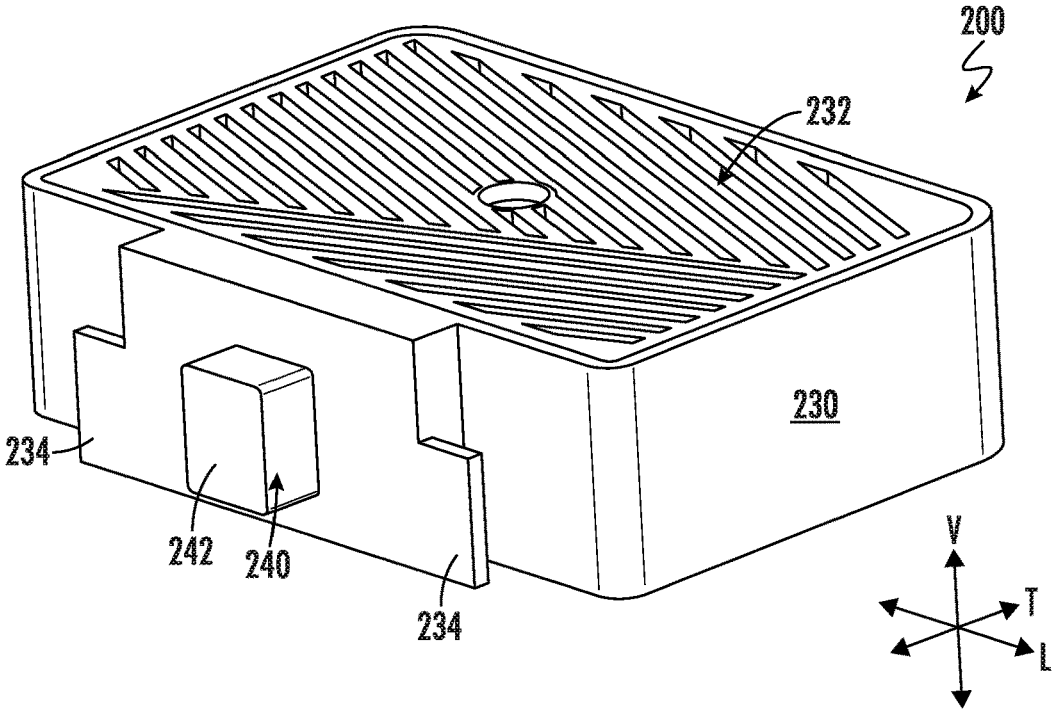
FIG. 4 provides a rear perspective view of a tray assembly of the exemplary dispensing assembly of FIG. 3.
Figure 7:
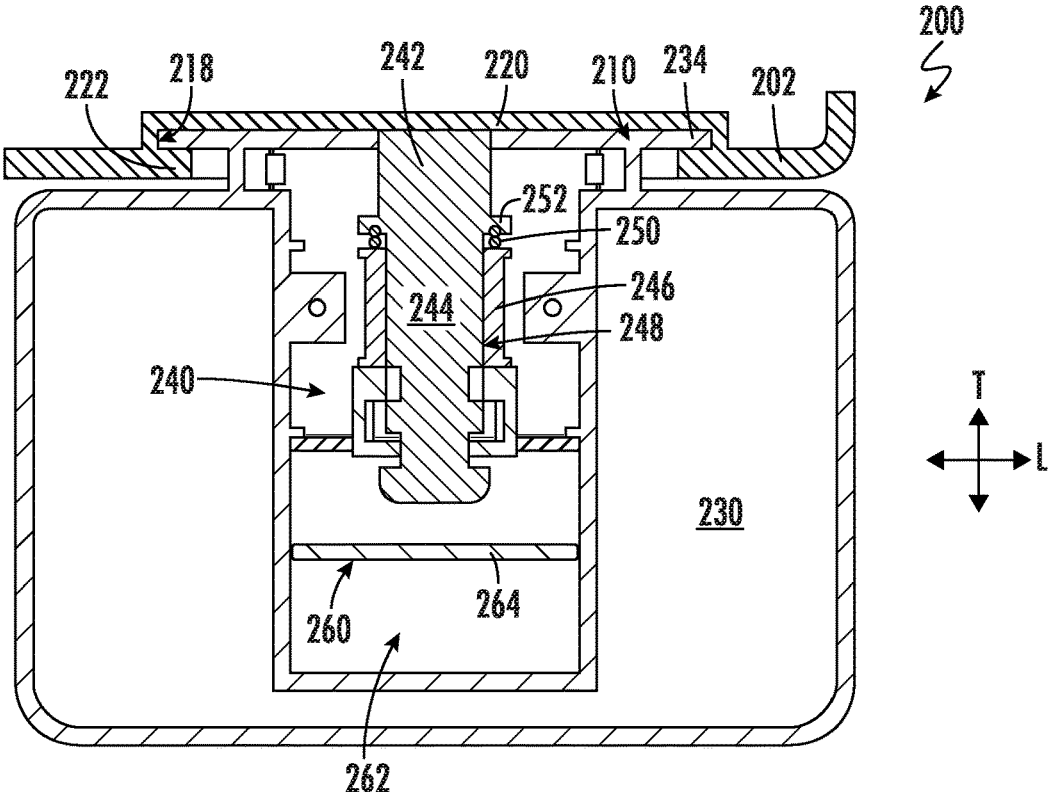
FIG. 7 provides a partial top view of the exemplary dispensing assembly of FIG. 3 with a plunger mechanism in the disengaged position.
Figure 8:
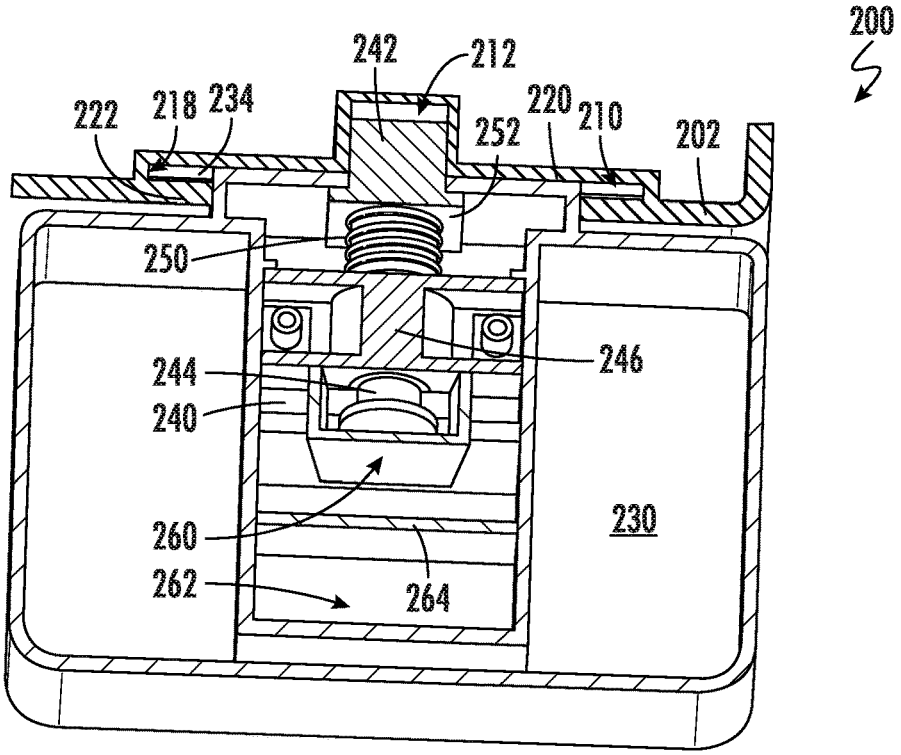
FIG. 8 provides a perspective, cross sectional view of the exemplary dispensing assembly of FIG. 3 with a plunger mechanism in the engaged position.
Figure 9:
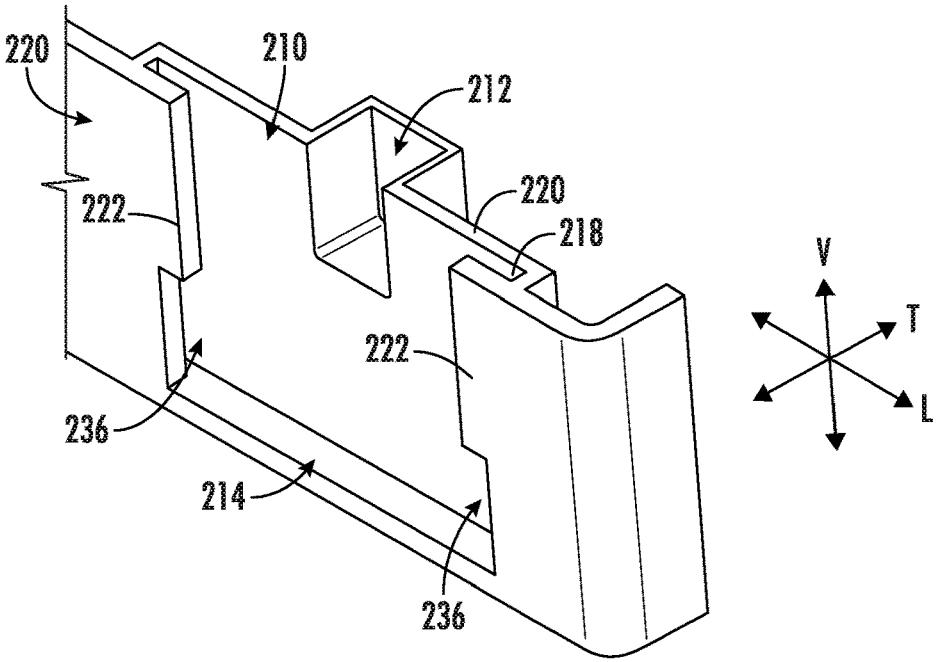
FIG. 9 provides a perspective, cross sectional view of a mounting panel of the exemplary dispensing assembly of FIG. 3.
Figure 10:
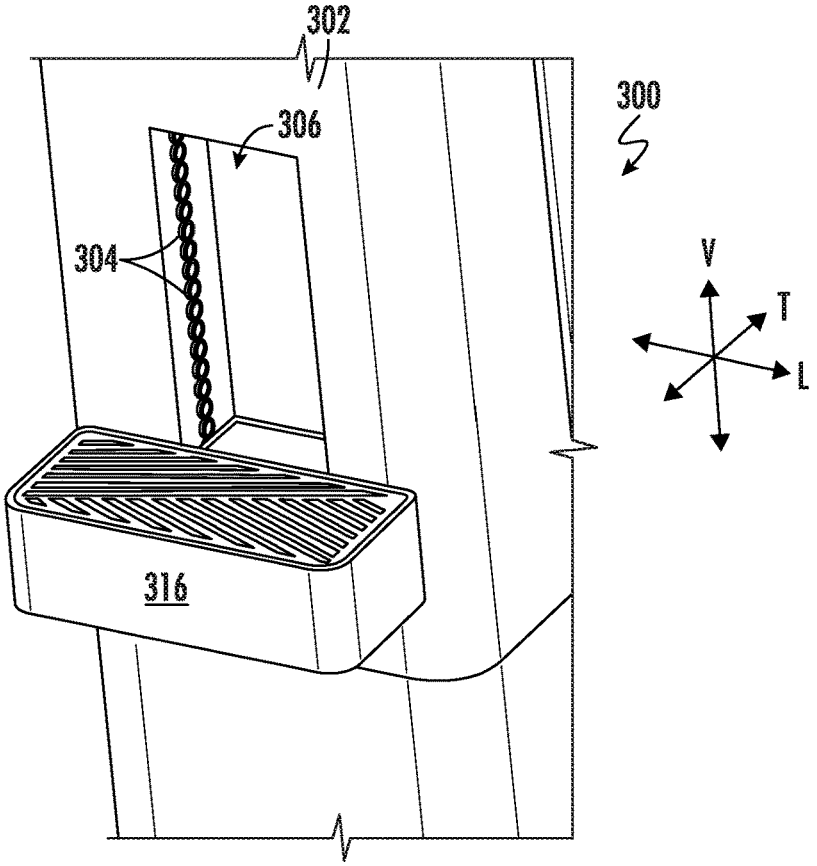
FIG. 10 provides a perspective view of a dispensing assembly that may be used with the exemplary refrigerator appliance of FIG. 1 according to another exemplary embodiment of the present subject matter.
Figure 11:
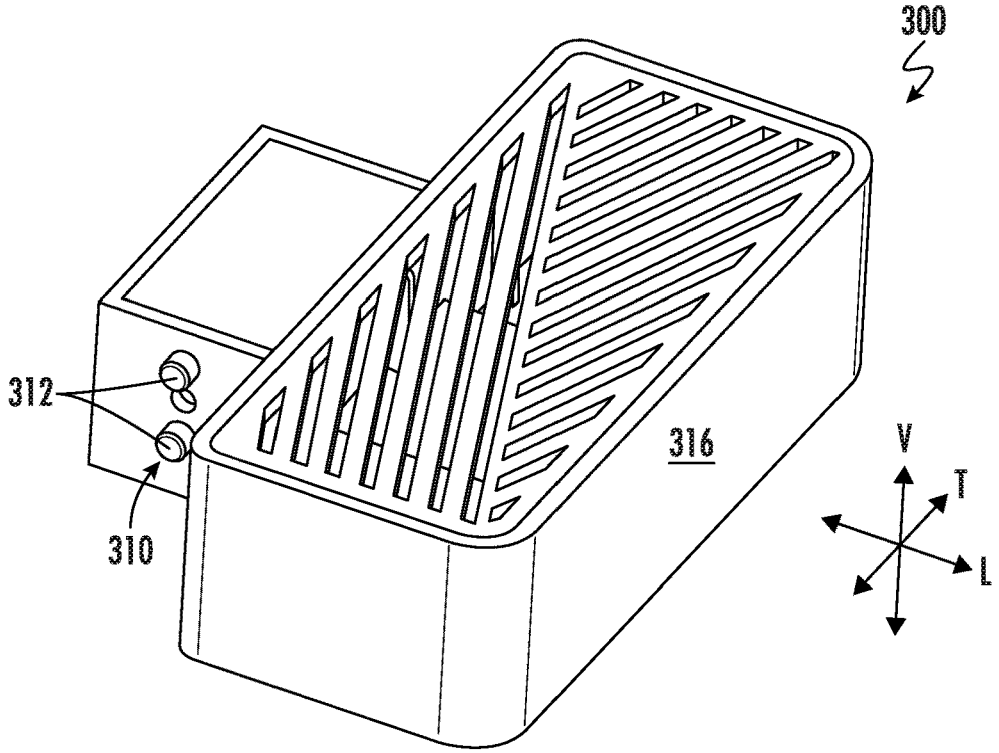
FIG. 11 provides a front perspective view of a tray assembly of the exemplary dispensing assembly of FIG. 10.
Figure 12:
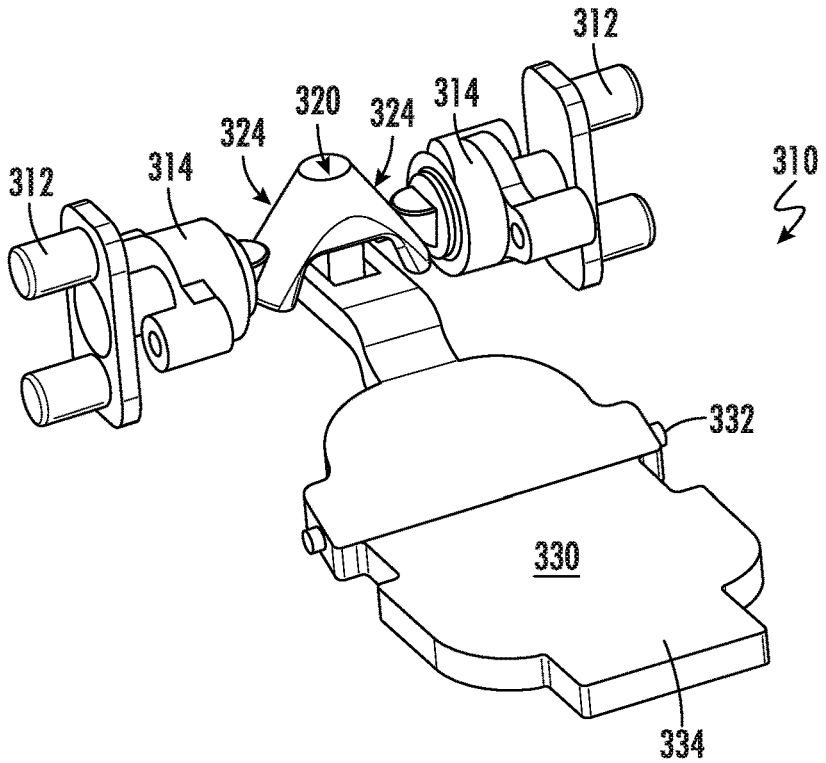
FIG. 12 provides a partial perspective view of the exemplary tray assembly of FIG. 11.
Figure 13:
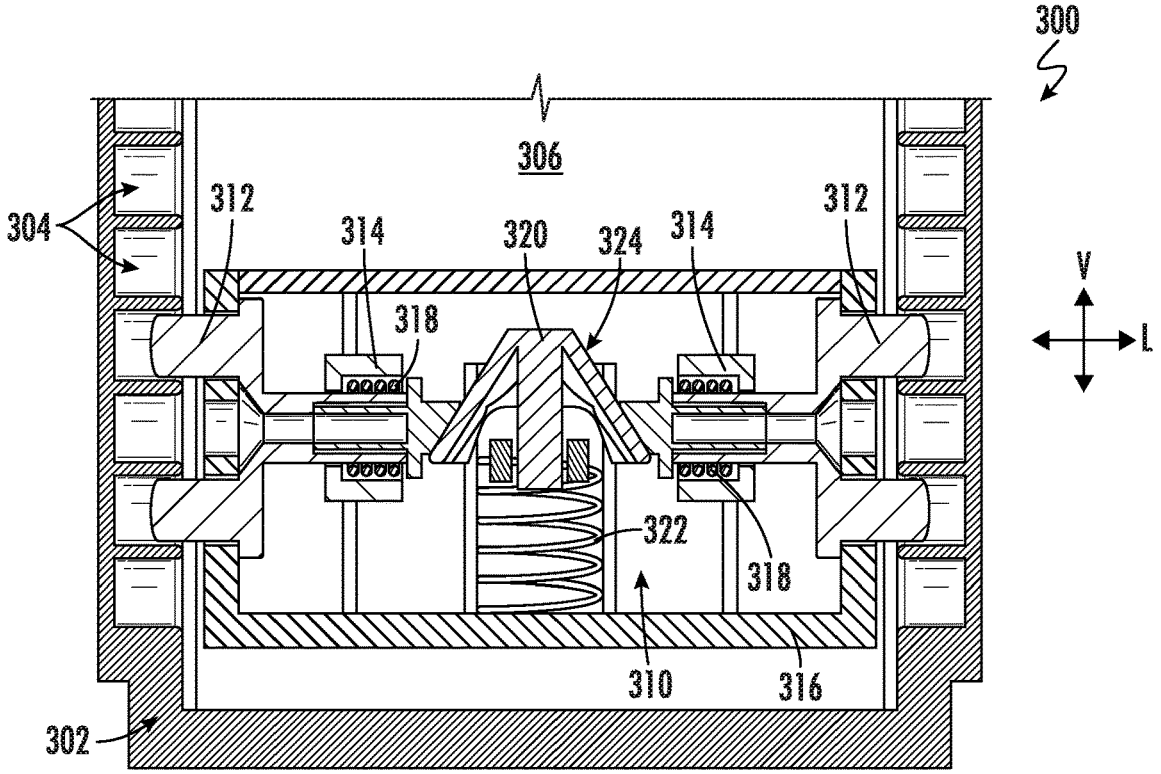
FIG. 13 provides a front, cross sectional view of the exemplary dispensing assembly of FIG. 10 with a plunger mechanism in an engaged position.

As best shown in FIGS. 4 and 7 through 8, tray 230 may define one or more locking flanges 234 that are generally configured for engaging sliding pocket 210. Specifically, when installed, locking flanges 234 may be positioned between forward flanges 222 and back wall 220 of sliding pocket 210, such that movement of tray assembly 200 is only permitted in the vertical direction V. Notably, it may be desirable to periodically remove tray assembly 200, e.g. for cleaning and/or maintenance. Thus, as best shown in FIGS. 4 and 9, forward flanges 222 may define a tray release recess 236 through which locking flanges 234 may be passed to remove tray assembly 200 from mounting panel 202. According to the illustrated embodiment, tray release recess 236 is positioned proximate a bottom of sliding pocket 210, e.g., such that locking flanges 234 must be seated against bottom wall 214 before tray assembly 200 may be pulled outward from sliding pocket 210 along the transverse direction T. It should be appreciated that according to alternative embodiments, tray release recess 236 may be positioned at any other suitable location, e.g., such as proximate a top of sliding pocket 210. Moreover, other suitable mechanisms for releasing tray assembly 200 from mounting panel 202 are possible and within the scope of the present subject matter.

Tray assembly 200 further includes features for locking drip tray 230 in vertical position within sliding pocket 210. Specifically, as best shown in FIGS. 4 through 8, tray assembly 200 includes a plunger mechanism 240 that is movably mounted to drip tray 230 for engaging and/or disengaging mounting panel 202. More specifically, plunger mechanism 240 may move between an engaged position (see, e.g., FIGS. 4, 5, and 8) where a locking pin 242 of plunger mechanism 240 engages or is inserted within one of the locking indentations 212 such that drip tray 230 is prevented from motion in any direction. By contrast, plunger mechanism 240 may be moved to a disengaged position (see, e.g., FIGS. 6 and 7) where locking pin 242 is retracted from locking indentations 212 such that drip tray 230 is movable along the vertical direction V within sliding pocket 210.

According to the illustrated embodiment, locking pin 242 is defined on a distal end of a plunger body 244. Plunger body 244 is slidably mounted within drip tray 230 using a slide bearing member 246. Specifically, slide bearing member 246 defines an aperture 248 and a low friction interface through which plunger body 244 passes. In this manner, slide bearing member 246 permits plunger body 244 to slide along the transverse direction T within drip tray 230. A biasing member 250, such as a spring element or mechanical spring, may be mounted around plunger body 244 for urging plunger body 244 toward the extended position, e.g., the engaged position where locking pin 242 seeks to engage locking indentations 212. Plunger body 244 may further define a stopping flange 252 to prevent plunger body from being pushed out of drip tray 230.

Figure 5:
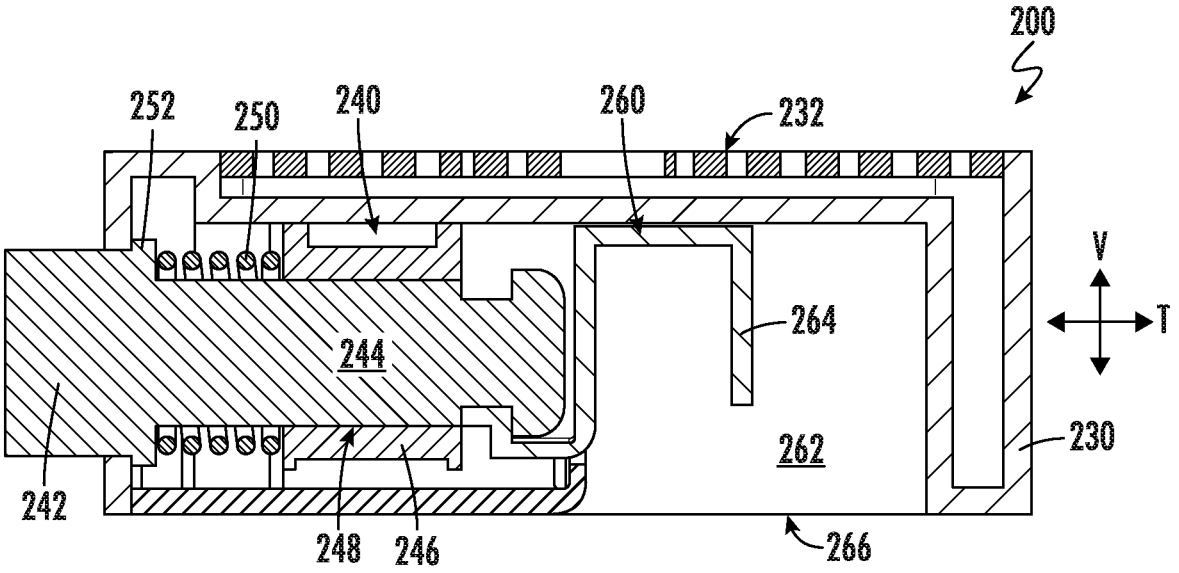
FIG. 5 provides a side, cross sectional view of the exemplary dispensing assembly of FIG. 3 with a plunger mechanism in an engaged position.
Figure 6:
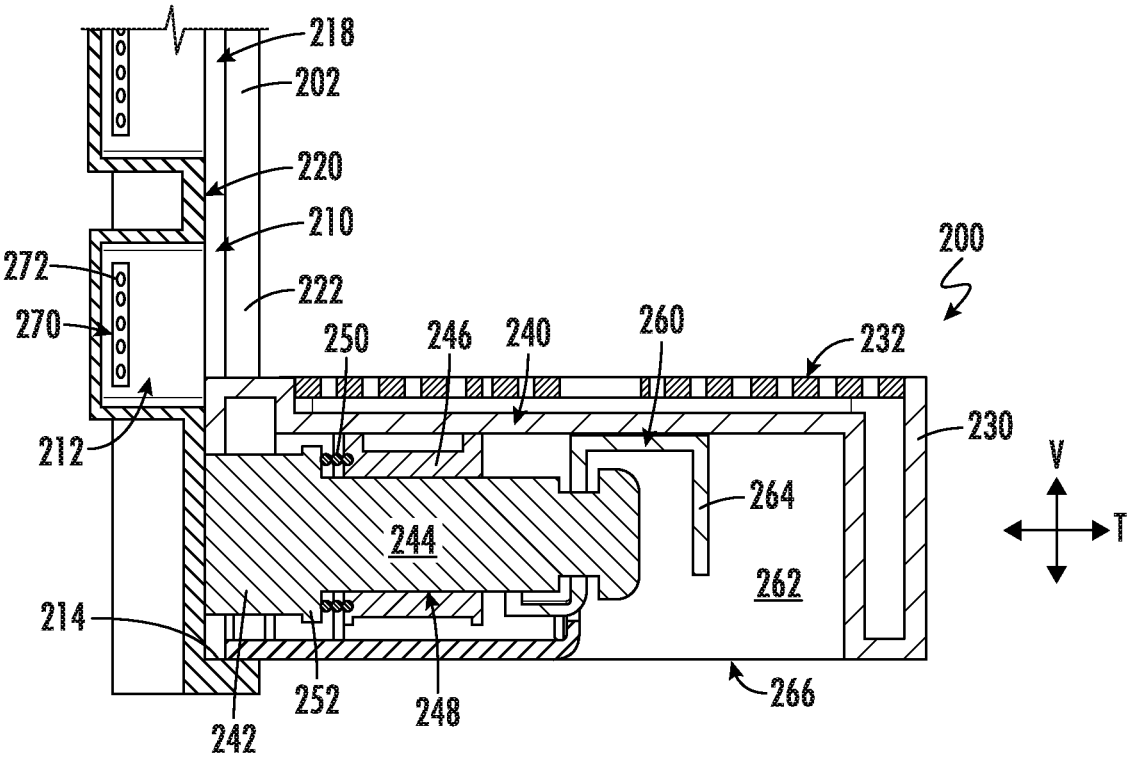
FIG. 6 provides a side, cross sectional view of the exemplary dispensing assembly of FIG. 3 with a plunger mechanism in a disengaged position.

Referring now to FIGS. 5 and 6, tray assembly 200 may further include a handle mechanism 260 that is operably coupled to plunger mechanism 240 to permit a user to move plunger mechanism 240 between the engaged and disengaged position. Specifically, handle mechanism 260 is positioned inside a cavity 262 of drip tray 230 such that a grip 264 is accessible through a lower opening 266 defined in the bottom of drip tray 230. Handle mechanism is mechanically connected to plunger body 244 in any suitable manner such that pulling grip 264 compresses biasing member 250 and draws plunger body 244 and locking pin 242 into the retracted or disengaged position. In this manner, a user may quickly and easily adjust the vertical position of tray assembly 200 by squeezing handle mechanism 260 and moving drip tray 230 vertically until locking pin 242 is aligned with one of the locking indentations 212. At that point, the user may release handle mechanism 260 such that biasing member 250 urges plunger body 244 and locking pin 242 into the extended or engaged position, thereby fixing drip tray 230 into its vertical position.

In order to improve visibility of locking indentations 212 while also improving the aesthetic appearance of tray assembly 200, dispensing assembly 140 may further include a lighting assembly 270 positioned in any suitable manner for illuminating tray assembly 200. For example, according to the illustrated embodiment and as best shown in FIG. 6, lighting assembly 270 may include a plurality of light sources 272, e.g., such as light emitting diodes (LEDs) that are positioned at the deepest point within locking indentations 212. Other suitable positions and types of light sources 272 are possible and within the scope of the present subject matter.

Referring now to FIGS. 10 through 15, a tray assembly 300 according to an alternative embodiment of the present subject matter will be described. Due to the similarity between the embodiments described and the particular applications in which they may be used, like reference numerals may be used to refer to the same or similar features between the embodiments. It should further be appreciated that features and components of tray assemblies 200 and 300 may be used interchangeably with each other to form still further embodiments of the present subject matter. Moreover, due to the similarity in designs, discussion of certain features of tray assembly 300 will be omitted herein for brevity.

Figure 14:
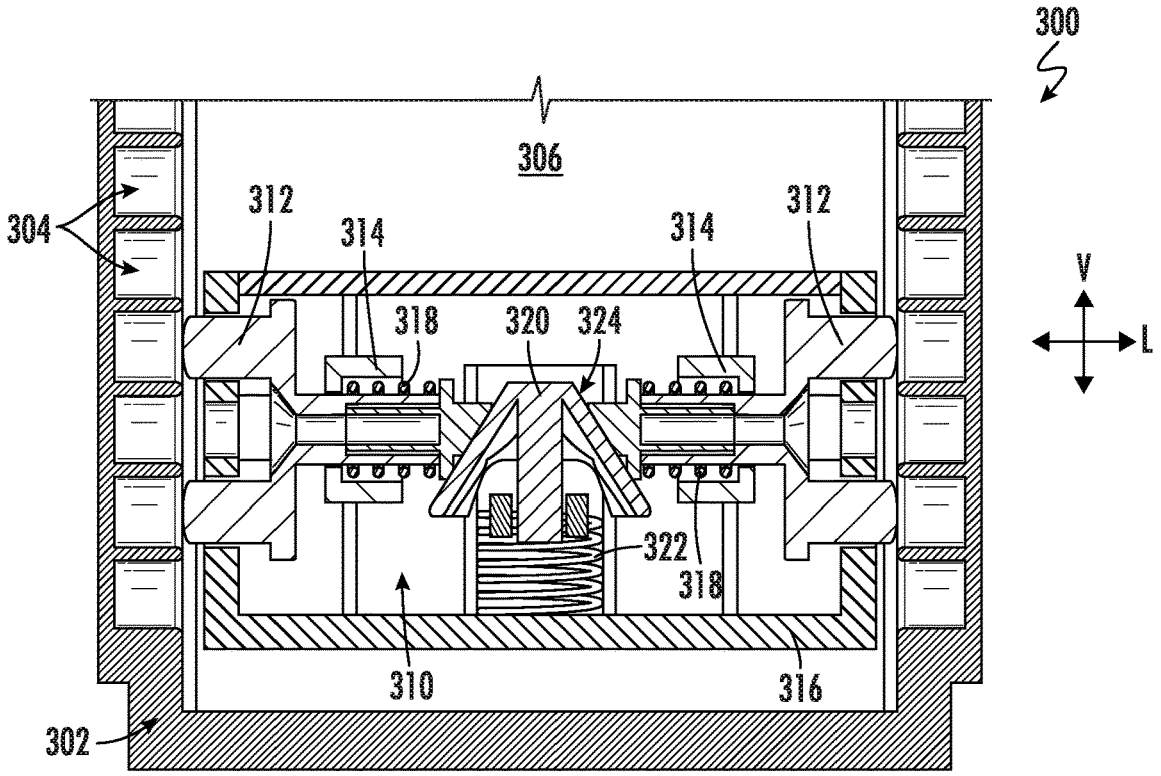
FIG. 14 provides a front, cross sectional view of the exemplary dispensing assembly of FIG. 10 with a plunger mechanism in a disengaged position.
Figure 15:
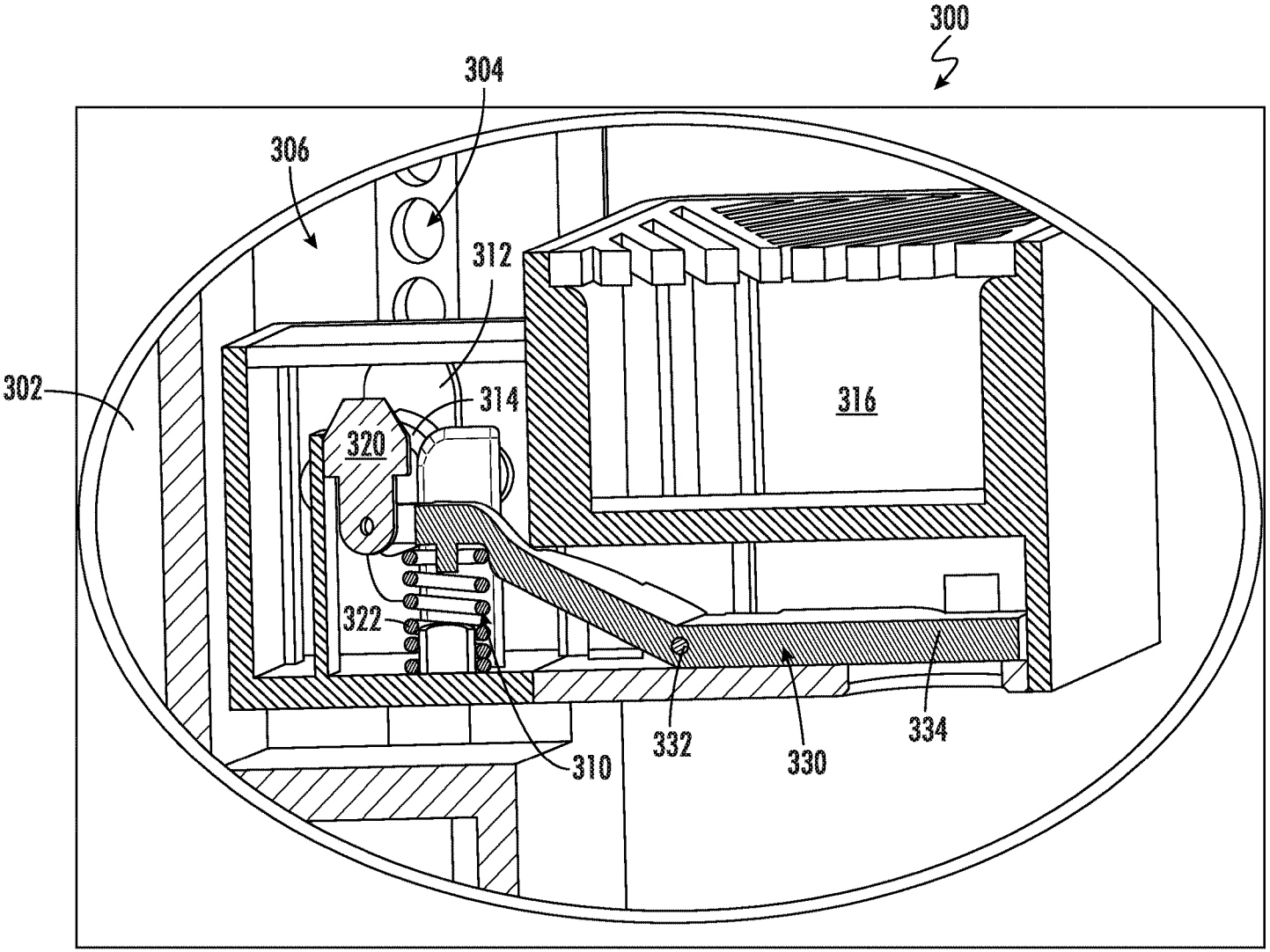
FIG. 15 provides a perspective, cross sectional view of the exemplary dispensing assembly of FIG. 10.

Notably, tray assembly 300 is similar in many respects to translate 200, with the primary difference being the manner in which tray assembly 300 engages the corresponding mounting panel. Specifically, mounting panel 302 defines a plurality of lateral indentations 304 within a sliding pocket 306. Similar to tray assembly 200, tray assembly 300 includes a plunger mechanism 310 for selectively engaging lateral indentations 304. Specifically, plunger mechanism 310 includes locking pins 312 slidably mounted within slide bearings 314 for slidably mounting locking pins 312 within drip tray 316. Mechanical springs 318 are positioned between slide bearing 314 and locking pins 312 to urge locking pins 312 toward the retracted position (FIG. 14).

However, plunger mechanism 310 also includes a cam element 320 that is slidably mounted within drip tray 316 such that it may move along the vertical direction V. A cam spring 322 urges cam element 320 upward toward a raised position. Cam element 320 defines a sloped surface 324 that engages locking pins 312 to push them outward against the force of mechanical springs 318 when cam element 320 is in the raised position. In addition, plunger mechanism 310 may include a lever arm 330 that is pivotally mounted around a pivot point 332 and that engages cam element 320 on its distal end. In the relaxed position, cam spring 322 urges cam element 320 upward along the vertical direction V such that the sloped surface 324 urges locking pins 312 outward and into an engaged position with mounting panel 302. However, when a user presses upward on an actuating flap 334 of lever arm 330, lever arm 330 pivots about pivot point 332, and compresses cam spring 322 to lower cam element 320. Mechanical springs 318 then urge locking pins 312 into the retracted position such that drain assembly 300 may move along the vertical direction V. Although two embodiments of tray assemblies have been described herein, it should be appreciated that other configurations are possible and within the scope of the present subject matter.

The written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dispensing assembly for an appliance, the dispensing assembly defining a vertical direction, a lateral direction, and a transverse direction, the dispensing assembly comprising:

a dispenser for dispensing ice or a beverage;

a mounting panel positioned below the dispenser, the mounting panel defining a sliding pocket and a locking indentation within the sliding pocket; and a tray assembly movably mounted to the mounting panel, the tray assembly comprising:

a drip tray defining a support surface and a locking flange for receipt within the sliding pocket; and a plunger mechanism movably mounted to the drip tray and being configured for moving between an engaged position where a locking pin of the plunger mechanism engages the locking indentation to lock the drip tray in position along the vertical direction and a disengaged position where the locking pin is retracted such that the drip tray is movable along the vertical direction.

2. The dispensing assembly of claim 1, wherein the mounting panel defines a plurality of indentations at different locations along the vertical direction, and wherein the plunger mechanism locks the drip tray in any one of the plurality of indentations when in the engaged position.

3. The dispensing assembly of claim 2, wherein each of the plurality of indentations are defined within a back wall of the sliding pocket.

4. The dispensing assembly of claim 1, wherein the locking indentation is elongated along the vertical direction, and wherein the mounting panel further comprises:

a stair-step structure positioned within the locking indentation such that a depth of the locking indentation measured along the transverse direction increases progressively toward a top of the locking indentation.

5. The dispensing assembly of claim 1, wherein the tray assembly further comprises:

a handle mechanism operably coupled to the plunger mechanism, wherein pulling the handle mechanism moves the plunger mechanism into the disengaged position.

6. The dispensing assembly of claim 5, wherein the tray assembly further comprises:

a lower opening defined in a bottom of the drip tray, wherein the handle mechanism is accessible through the lower opening.

7. The dispensing assembly of claim 1, wherein the tray assembly further comprises:

a spring element that urges the plunger mechanism toward the engaged position.

8. The dispensing assembly of claim 1, wherein the sliding pocket is defined at least in part by forward flanges that constrain the movement of the drip tray along the lateral direction and the transverse direction.

9. The dispensing assembly of claim 8, wherein the forward flanges define a tray release recess through which the locking flange passes to remove the tray assembly.

10. The dispensing assembly of claim 9, wherein the tray release recess is defined at a bottom of the sliding pocket.

11. The dispensing assembly of claim 1, wherein the tray assembly further comprises:

a slide bearing member defining an aperture, the plunger mechanism being slidably received within the aperture.

12. The dispensing assembly of claim 1, wherein the dispensing assembly further comprises:

a lighting assembly positioned within the locking indentation.

13. The dispensing assembly of claim 1, wherein the locking indentation is defined on a side of the sliding pocket along the lateral direction, and wherein the locking pin is slidably mounted to the drip tray and is movable along the lateral direction between the engaged position where the locking pin engages the locking indentation to lock the drip tray in position along the vertical direction and the disengaged position where the drip tray is movable along the vertical direction, wherein the plunger mechanism comprises:

a cam element operably coupled to the locking pin and being movable along the vertical direction for moving the locking pin between the engaged position and the disengaged position;

a spring element urging the cam element upward along the vertical direction; and a lever arm operably coupled to the cam element for moving the cam element and the locking pin between the engaged position and the disengaged position.

14. The dispensing assembly of claim 1, wherein the appliance is a refrigerator appliance, an icemaker, or a beverage dispenser.

15. A tray assembly for a dispensing assembly, the dispensing assembly comprising a dispenser and a mounting panel positioned below the dispenser and defining a locking indentation within a sliding pocket, the tray assembly comprising:

a drip tray defining a support surface and a locking flange for receipt within the sliding pocket; and a plunger mechanism movably mounted to the drip tray and being configured for moving between an engaged position where a locking pin of the plunger mechanism engages the locking indentation to lock the drip tray in position along a vertical direction and a disengaged position where the locking pin is retracted such that the drip tray is movable along the vertical direction.

16. The tray assembly of claim 15, wherein the mounting panel defines a plurality of indentations at different locations along the vertical direction, and wherein the plunger mechanism locks the drip tray in any one of the plurality of indentations when in the engaged position.

17. The tray assembly of claim 15, further comprising:

a handle mechanism operably coupled to the plunger mechanism, wherein pulling the handle mechanism moves the plunger mechanism into the disengaged position; and a lower opening defined in a bottom of the drip tray, wherein the handle mechanism is accessible through the lower opening.

18. The tray assembly of claim 15, wherein the sliding pocket is defined at least in part by forward flanges that constrain the movement of the drip tray along a lateral direction and a transverse direction.

19. The tray assembly of claim 18, wherein the forward flanges define a tray release recess defined at a bottom of the sliding pocket through which the locking flange passes to remove the tray assembly.

20. The tray assembly of claim 15, wherein the locking indentation is defined on a side of the sliding pocket along a lateral direction, and wherein the locking pin is slidably mounted to the drip tray and is movable along the lateral direction between the engaged position where the locking pin engages the locking indentation to lock the drip tray in position along the vertical direction and the disengaged position where the drip tray is movable along the vertical direction, wherein the plunger mechanism comprises:

a cam element operably coupled to the locking pin and being movable along the vertical direction for moving the locking pin between the engaged position and the disengaged position;

a spring element urging the cam element upward along the vertical direction; and a lever arm operably coupled to the cam element for moving the cam element and the locking pin between the engaged position and the disengaged position.

* * * * *